US008636825B2

(12) United States Patent
Schiefer et al.

(10) Patent No.: US 8,636,825 B2
(45) Date of Patent: Jan. 28, 2014

(54) MELTING METHOD FOR PRODUCING AN INCLUSION-FREE TA-BASE ALLOY

(75) Inventors: Herwig Schiefer, Frankfurt (DE); Christoph Vogt, Hanau (DE); Heiko Specht, Hanau (DE); Jens Troetzschel, Neuwiedermus (DE); Egbert Stiedl, Bruchkoebel (DE)

(73) Assignee: W. C. Heraeus GmbH, Hanau (DE)

( * ) Notice: Subject to any disclaimer, the term of this patent is extended or adjusted under 35 U.S.C. 154(b) by 250 days.

(21) Appl. No.: 13/091,852

(22) Filed: Apr. 21, 2011

(65) Prior Publication Data

US 2011/0264161 A1 Oct. 27, 2011

(30) Foreign Application Priority Data

Apr. 23, 2010 (DE) ..... 10 2010 018 303

(51) Int. Cl.
*C22C 47/14* (2006.01)
*C22C 27/02* (2006.01)

(52) U.S. Cl.
USPC ..... 75/662; 75/770; 419/61; 420/590

(58) Field of Classification Search
USPC ..... 75/770, 622; 419/61; 420/590
See application file for complete search history.

(56) References Cited

U.S. PATENT DOCUMENTS

| | | | |
|---|---|---|---|
| 3,592,637 A | 7/1971 | Brown et al. | |
| 5,374,295 A | 12/1994 | Miura et al. | |
| 8,394,170 B2 * | 3/2013 | Schiefer et al. | 75/622 |
| 2006/0153729 A1 | 7/2006 | Stinson et al. | |
| 2010/0168841 A1 | 7/2010 | Furst et al. | |
| 2011/0033335 A1 | 2/2011 | Schiefer et al. | |
| 2011/0129386 A1 | 6/2011 | Schiefer et al. | |

FOREIGN PATENT DOCUMENTS

| | | |
|---|---|---|
| DE | C 5588 VI | 8/1956 |
| DE | 691 26 973 | 11/1991 |
| EP | 0801138 | 10/1997 |
| EP | 1444993 | 11/2004 |
| JP | 359035642 | 2/1984 |
| WO | 9118121 | 11/1991 |
| WO | 2009079282 | 6/2009 |

OTHER PUBLICATIONS

"Periodic Table: Melting Point" at http://www.chemicalelements.com/index.html. Created by Yinon Bentor. Copyright 1996-2009. Downloaded May 31, 2012.

(Continued)

*Primary Examiner* — George Wyszomierski
*Assistant Examiner* — Tima M McGuthry Banks
(74) *Attorney, Agent, or Firm* — Dicke, Billig & Czaja, PLLC

(57) ABSTRACT

One aspect relates to a method for producing an alloy characterized by grinding tantalum to form a tantalum powder and grinding tungsten to form a tungsten powder; mixing the tantalum powder and the tungsten powder to form a blended powder. The weight fraction of tungsten powder in the blended powder is larger than in the desired alloy. A blended body is produced from the blended powder by a powder metallurgical route. A pre-alloy is produced by a first melting of the blended body and at least a fraction of at least one further metal by a melt metallurgical route. The alloy is produced by a second melting of the pre-alloy and the remaining fraction of at least one metal by a melt metallurgical route.

11 Claims, 2 Drawing Sheets

(56) References Cited

OTHER PUBLICATIONS

The Office Action for U.S. Appl. No. 12/851,892 mailed Jun. 5, 2012 (18 pages).
The Restriction Requirement for U.S. Appl. No. 12/959,031 mailed May 16, 2012 (6 pages).
The Office Action for U.S. Appl. No. 12/959,031 mailed Jul. 17, 2012 (14 pages).
O'Brien, Barry et al., "Development of a New Niobium-Based Alloy for Vascular Stent Applications," Journal of the Mechanical Behavior of Biomedical Materials I, pp. 303-312 (2008).

* cited by examiner

MELTING METHOD FOR PRODUCING AN INCLUSION-FREE TA-BASE ALLOY

CROSS-REFERENCE TO RELATED APPLICATIONS

This Utility Patent Application claims priority to German Patent Application No. DE 10 2010 018 303.2, filed on Apr. 23, 2010, which is incorporated herein by reference.

BACKGROUND

One aspect relates to a method for producing an alloy, whereby the alloy consists of three metals and the three metals are selected from the group consisting of tantalum, tungsten, and niobium.

In known production methods, bars of pure metal are bundled and melted in a high vacuum, for example, by means of electron beam. It has proven to be disadvantageous in some cases that the element of alloys that has the highest melting point is melted only incompletely in the process. To some extent, larger lumps, for example, of tungsten, drop into the melt bath during the melting process without mixing with the other alloy components. Referred to as inclusions or mono-elemental regions, said non-melted lumps of one of the alloy metals lead to failure of the material at a later time, when the alloy is drawn into a wire. This can lead to fissures or cavities arising at said inclusions. Moreover, said inclusions render the processing more difficult. For example, the inclusions reduce the fatigue resistance of the component and lead to local corrosion of a wire made of the alloy.

For these and other reasons there is a need for the present invention.

SUMMARY

One embodiment creates a method for producing an alloy from the metals tantalum, tungsten, and niobium, in which the disadvantages mentioned above are prevented, in particular to provide a method that reduces the maximal size of the inclusions as compared to known methods.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

Further advantages, features, and details of the invention are evident from the subclaims and the description in the following, in which several exemplary embodiments of the invention are described in detail making reference to the drawings. The features mentioned in the claims and the description can be essential for the invention both alone or in any combination thereof.

DETAILED DESCRIPTION

Figure 1:
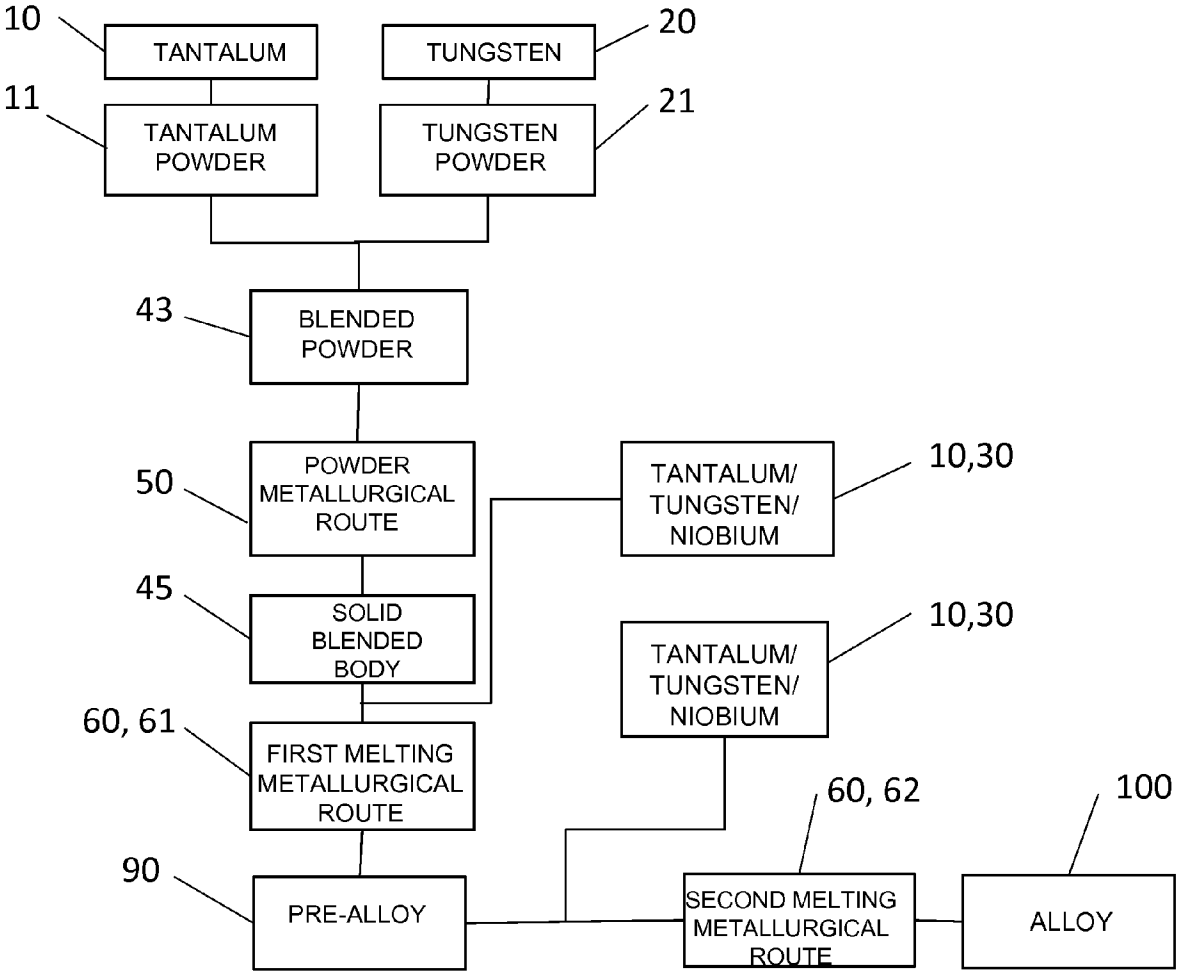
FIG. 1 illustrates a flow diagram of the method according to one embodiment.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

One embodiment provides a method for producing an alloy, and another for a use of the alloy produced according to the method, and another for an implantable medical device. Features and details that are described in the context of the method shall also apply in the context of the implantable medical device and use, and vice versa.

The method according to one embodiment is characterised in that the method includes the steps of a) grinding the tantalum to form a tantalum powder and grinding the tungsten to form a tungsten powder;

b) mixing the tantalum powder and the tungsten powder to form a blended powder, whereby the weight fraction of tungsten powder in the blended powder is larger than in the desired alloy;

c) producing a blended body from the blended powder by means of a powder metallurgical route;

d) producing a pre-alloy by means of a first melting of the blended body and at least a fraction of at least one further metal by means of a melt metallurgical route; and e) producing the alloy by means of a second melting of the pre-alloy and the remaining fraction of at least one metal by means of a melt metallurgical route.

One feature of the method according to one embodiment is that the scope of producing the alloy that consists of three metals includes first producing a blended body that includes only two of the three metals. Accordingly, a blended powder is produced from tantalum powder and tungsten powder and processed to form a blended body by means of the powder metallurgical route. Mixing the tantalum powder and the tungsten powder to form a blended powder allows a blended body with a homogeneous distribution to be produced. In this context, any volume unit of the blended powder and/or blended body of a size exceeding 1 $mm^3$, in particular exceeding 0.1 $mm^3$, has the same mixing ratio as the weight ratio of the two starting materials. This ensures a homogeneous distribution of the two alloy elements tantalum and tungsten to exist in the blended body which is to be processed further. At the end of the method according to one embodiment, this results in an alloy, which no longer includes mono-elemental regions that weaken elements such as wires made from the alloy, which is in contrast to the prior art.

Moreover, the method according to one embodiment is characterised in that the weight fraction of the tungsten powder in the blended powder is larger than in the desired alloy. A balancing of the weight fractions of the two other components of the alloy can be effected in one and/or both melting steps.

The method according to one embodiment is characterised in that two melting steps that are independent of each other are undertaken. A first melting, in which a pre-alloy is produced, is carried out first. Said pre-alloy consists, on the one hand, of the metals of the blended body, that is, tantalum and tungsten, to which is then added at least a fraction of at least one further metal. Accordingly, there is no need in the scope of the first melting process for all three metals to be melted in any weight ratio with respect to each other that is desired in the final alloy. The scope of the first melting ensures that the high melting metal, tungsten, in particular, is melted completely. In known melting methods, it is common for the low melting components of the alloy to be melted to form small particles. However, measurements on alloys that include the high melting metal, tungsten, illustrate that the latter is not melted completely, but rather that major lumps drop into the melt bath. This disadvantage is overcome by means of combining steps I.) powder metallurgical production of a blended body and ii.) two-fold melting of the alloy metals.

The scope of step d) includes a first melting of the blended body in the presence of at least some weight fractions of at least one of the three metals of the alloy. Accordingly, three different situations in terms of the at least one further metal may arise in the scope of the first melting. The following additions may be made:

i: tantalum and niobium;

ii: niobium; or iii: tantalum.

The added fraction of the at least one metal added can correspond to the weight fraction this metal or these metals are to have in the alloy later on or be a higher or lower fraction than in the final alloy. The balancing of the fractions that deviate from the final composition of the alloy is effected in the scope of the second melting. The remaining fractions of the at least one metal can be melted along with the balancing. Accordingly, the following additions may be made in the scope of the second melting:

aa: tantalum and niobium;

bb: niobium; or cc: tantalum.

Accordingly, there are nine different variations of metal additions to the blended body and/or the pre-alloy that may be made in the scope of the first and/or second melting.

In one embodiment, it has proven to be a preferred combination for the method if steps d) and e) are carried out as follows by d) producing the pre-alloy by means of the first melting of the blended body and tantalum by means of a melt metallurgical route; and e) producing the alloy by means of the second melting of the pre-alloy and niobium by means of a melt metallurgical route.

Adding the different metals as described ensures that only the material with the lowest melting point, niobium, is added during the second melting. The metals with higher melting temperatures have been connected to each other in the earlier steps—formation of the blended body and first melting. Homogeneous distribution can be ensured in this manner. The second melting and the associated addition of niobium prevents mono-elemental regions from arising in that the high melting metals have already been distributed and melted accordingly at an earlier time.

Another development of the method according to one embodiment is characterised in that the weight fraction of niobium and/or tantalum during the first melting is 0.5 wt-% to 4 wt-%, in particular 1 wt-% to 2 wt-%, larger than in the desired alloy. Increasing the weight fraction of the metal, niobium, during the first melting also allows a very even and homogeneous alloy to be produced.

One embodiment is characterised in that two production pathways for alloys are combined. In this manner, advantages of the powder metallurgical route and of the melt metallurgical route are combined. Performing the two routes to be illustrated in more detail below—powder metallurgical and melt metallurgical—sequentially results in alloys whose inclusions are less than 4 μm in size. In the context of one embodiment, inclusion or mono-elemental region shall mean a region in the alloy that includes only one of the various metals of the alloy. This mono-elemental region consists of only one metal of the alloy and contacts the other metals of the alloy only on its outside surfaces. One advantage of the powder metallurgical route is that it allows good homogenization and easy alloying to be achieved at low sintering temperatures. In one embodiment, these advantages are combined with the advantages of the melt metallurgical route, that is, the high level of purity of the alloy that can be achieved and the feasibility of alloying high-melting metals together.

In the context of one embodiment, the term, "powder metallurgical route", denotes a manufacturing process, in which a metal object is manufactured from a metal powder. The term, "powder metallurgical route", includes, in particular, the following manufacturing processes: hot pressing, sintering, hot isostatic pressing. Hot pressing involves shaping and compacting a metal powder into a metal object by exposure to—in particular uniaxial—pressure and temperature. Sintering involves a heat treatment, in which an object consisting of metal powder is compacted. In hot isostatic pressing (HIP), a metal powder that has been filled into a mold is compacted into a metal object with approximately 100% density (isostatic) by means of high pressure and high temperature. In the scope of one embodiment, bodies can be made from dry, metallic powders or slurries in the powder metallurgical route. A dry powder is compacted in the dry state to form a green blank and has sufficient adhesion to maintain its green blank shape. In the scope of one embodiment, a slurry is a suspension of particles of a powder in a liquid binding agent, usually in water or an organic binding agent. A slurry has a high viscosity and can be formed into a green blank easily without high pressure. During sintering, sintering necks are formed between the particles of the green blank which effect firmly bonded connection of the particles to each other.

Because of the high affinity for oxygen, it has proven to be advantageous in one embodiment to melt refractory metals under vacuum conditions. This allows pre-existing impurities to be removed and gas inclusions in metals to be prevented. In the context of one embodiment, the term, "melt metallurgical route", means a manufacturing process, in which a metal object is melted by exposure to an energy source in a vacuum. The term, "melt metallurgical route", includes, in particular, the following manufacturing processes: vacuum induction, electron beam melting, and arc melting. In vacuum induction, the metal object to be melted is melted in a crucible by means of induction under vacuum conditions and then poured into a water-cooled crucible. In electron beam melting, energy-rich electron beams are used under vacuum conditions to melt high-melting materials, which are then poured into an ingot mould with a floor, which can be lowered, and cooled walls. In arc melting, an arc is ignited between the metal object to be melted and an electrode by means of a high voltage and under vacuum conditions, which causes the material to melt.

One special feature of one embodiment is that the method utilizes a two-step process. A powder metallurgical route is used first, followed by means of a melt metallurgical route. One embodiment provides at least the tantalum and the tungsten to each be ground and processed to form a blended powder. Based on said blended powder, the blended body is then produced by means of the powder metallurgical route. In order to not have mono-elemental inclusions present in the finished alloy, it has proven to be advantageous in one embodiment if the tantalum powder and tungsten powder are mixed in the scope of a homogenization step. Said homogenization step can, if applicable, also be part of the powder metallurgical route. This allows an even distribution of the tungsten powder in the tantalum powder to be attained. There are no powder regions formed, in which just one metal is present. Rather, what is attained by means of the homogenization step is that the mixing ratio of the two metal powders with respect to each other is maintained by the blended powder and/or the blended body. In this context, the term, "maintained", is understood to mean that the same distribution of the first metal powder with respect to the second metal powder exists in each volume element within the blended powder and/or blended body provided the volume of the region concerned is at least 125-fold, in one embodiment 50-fold, in one embodiment 20-fold, larger than the volume taken up by a single grain of the tantalum powder and/or tungsten powder.

Any of the following methods, for example, can be applied in the scope of the homogenization step:

Use of pre-alloyed powder,

Coating of powder, or

Mechanical alloying.

The use of pre-alloyed powder proceeds as follows: a TaW body produced by means of HIP is treated with hydrogen, which causes the body to become brittle. The body is then processed to form a powder by grinding. Subsequently, the powder is aged in a vacuum at a temperature>600° C. in order to remove the hydrogen from the metal. Then the powder can be compacted and sintered by means of the powder metallurgical route. The following procedural steps result in the scope of homogenization by coating the powder: the main alloy component (for example, Ta powder particles) can be coated with a slurry (consisting of fine W powder and a binding agent). Subsequently, the coated powder particles are compacted and sintered jointly by means of the powder metallurgical route. The resulting steps involved in the scope of homogenization by coating the powder are as follows: The main alloy component (for example, Ta powder) can be coated with a slurry (consisting of fine W powder and a binding agent). Subsequently, the coated powder particles are compacted and sintered jointly using a PM route. The steps involved in the scope of mechanical alloying are as follows: intensive mechanical treatment of the powder (grinding at high rotational speed with many grinding spheres) leads to local welding of individual powder particles to each other. The high temperature produced in the procedure leads to diffusion between the welded particles which increases the adhesion significantly. The powder thus obtained is then compacted and sintered by means of the powder metallurgical route.

Another variant of a development of the method according to one embodiment is characterised in that the particle size of the tantalum powder and/or tungsten powder is less than 10 μm, in particular less than 4 μm. It is preferred in one embodiment for the tantalum to be ground to form a tantalum powder with a powder particle size of between 4 μm and 0.1 μm and/or the tungsten to be ground to form the tungsten powder with a second powder particle size of between 4 μm and 0.1 μm, in particular between 4 μm and 1 μm. In the scope of the method, both tantalum and tungsten each are ground to form metal powder. In order to ensure that the inclusions, that is, those regions in the alloy, in which only a single metal is present in elemental form, are small in size, the metals, tantalum and tungsten, must be ground fine enough during the preparation phase for the powder particle size of the individual metal powders to be between 4 μm and 0.1 μm, in particular between 4 μm and 1 μm, since the size of the powder particles is correlated to the size of the inclusions. In the context of one embodiment, the term, "powder particle size", is used to refer to the maximal size of those particles of the metal powder that is attained in the scope of grinding and an ensuing screening. Accordingly, the size of the mesh of the sieve used to screen the metal powder after grinding indicates the upper limit of the powder particle size. According to one embodiment, the required powder particle size shall specify the maximal size of a particle of the metal powder. No particle of the metal powder shall be of a size larger than the powder particle size, but can be of any smaller size.

Due to the grinding of the tantalum and tungsten, the size of tantalum and/or tungsten inclusions in the alloy is between 10 μm and 10 nm. If, in addition, step f) according to one embodiment—to be illustrated below—is performed multiply, it is feasible in the scope of the method according to one embodiment for the size of the inclusions to be between 4 μm and 20 nm, in particular between 2 μm and 50 nm. Said size is non-objectionable for the use in alloys of implantable medical devices.

One variant of a development of the method according to one embodiment is characterised in that the alloy includes the following weight fractions of the metals:

0.5 wt-% to 15 wt-% tungsten, 2 wt-% to 20 wt-% niobium, and tantalum accounting for the remaining fraction, in particular, in that the alloy includes the following weight fractions of the metals:

5.5 wt-% to 9.5 wt-% tungsten, 8 wt-% to 12 wt-% niobium, and tantalum accounting for the remaining fraction, in one embodiment preferably, in that the alloy includes the following weight fractions of the metals:

7.5 wt-% tungsten, 10 wt-% niobium, and tantalum accounting for the remaining fraction.

One embodiment provides the alloy to consist of the three metals, tantalum, niobium, and tungsten. It is self-evident that this alloy also contains the unavoidable impurities. Although the alloy is to ultimately consist of the three metals specified above, unavoidable impurities of the three metals cannot be prevented in the scope of the production process. Said unavoidable impurities should obviously also be part of the alloy, whereby it is desired to minimize their fraction to the extent possible. It has therefore proven to be preferred in one embodiment to use the three metals at the following purities:

tantalum more pure than 99.9%, in particular more pure than 99.95%, in one embodiment preferably more pure than 99.995%, tungsten more pure than 99.9%, in particular more pure than 99.95%, in one embodiment preferably more pure than 99.995%, niobium more pure than 99.9%, in particular more pure than 99.95%, in one embodiment preferably more pure than 99.995%.

Reduction of the impurities to the levels specified above allows alloys to be produced that are particularly biocompatible.

In order to attain particular purity of the alloy and to further reduce the size of any inclusions, it has proven to be advantageous in one embodiment to supplement the method to the effect that the method includes, after step e), the step of f) melting the alloy by means of the melt metallurgical route.

In the scope of procedural step f), the alloy generated in step e) is melted again. After the alloy generated in step e) has solidified, it can be melted again by means of the melt metallurgical route. Accordingly, it is conceivable, for example, to melt the alloy from step e) in a vacuum using an electron beam. Any inclusions, which already are less than 4 μm in size, can be further reduced in size by the repeated melting. A further development of said variant of a development provides for step f) to be carried out multiply. Accordingly, it has proven to be advantageous in one embodiment to carry out step f) two to ten times, in particular three to five times. Repeated melting of the alloy by means of the melt metallurgical route further reduces the size of the inclusions. In this context, it has been possible to realize inclusion sizes of clearly less than 1 μm, in particular less than 0.2 μm, by means of melting three to five times in the scope of step f). Alloys with inclusions of this size can be used to advantage in one embodiment for implantable medical objects. Inclusions of this size have a negligible influence on the fatigue resistance of the product. Moreover, repeated melting of the alloy leads to a reduction of the undesired impurities, such as iron, nickel or oxygen. Said impurities evaporate during the melting process that is carried out in a vacuum.

A use in an implantable medical device of an alloy that has been manufactured according to at least one of the methods described above is also claimed. The method according to one embodiment enables the production of an alloy that is particularly well-suited for implantable medical devices since no non-melted lumps of an alloy metal—also called mono-elemental region—arise. Rather, all alloy metals are melted such that no mono-elemental regions arise that might lead to fissures or cavities in implantable medical devices that are made up of the alloy that is produced according to one embodiment.

An implantable medical device that is characterised by the implantable medical device being made up, at least in part, by an alloy is also claimed, whereby the alloy is produced according to any one of the methods described above. In one embodiment, it has proven to be a preferred variant of a development of said implantable medical device that the implantable medical device is at least one of the following: an electrode, an electrode precursor product, a bone implant, a dental implant, a stent, a stent precursor product, a film/foil, a housing, in particular a cardiac pacemaker casing, a cable or an electrical lead. All medical devices mentioned above have diameters or wall thicknesses that are on the same order of magnitude as the size of non-melted lumps of an alloy metal in known production procedures. Accordingly, fissures or cavities arise in medical devices according to the prior art if said devices are produced from alloys according to known methods. The same is not true if the medical device is made up of an alloy that is produced according to the methods according to one embodiment.

One issue, to which the method according to one embodiment for producing an alloy relates, is that not all metals are distributed evenly in the finished alloy, in particular in the case of high-melting refractory metals, but rather regions—also called inclusions or mono-elemental regions—are formed, in each of which only one metal of the various metals used for the alloy is present in pure form. Inclusions of this type can significantly reduce the fatigue resistance of the finished product. In order to overcome this disadvantage, in one embodiment, a method for producing an alloy 100 from the refractory metals, niobium, tantalum, and tungsten is disclosed. In this context, a combination of said metals 10, 20, 30 to form a combination metal is referred to as alloy 100. The special feature according to one embodiment is that first a powder metallurgical route and subsequently a melt metallurgical route is used sequentially, that is, one after the other, to produce the alloy.

FIG. 1 illustrates a flow diagram illustrating the method according to one embodiment for producing the alloy 100. This is based on the two metals, tantalum 10 and tungsten 20. Each of these metals is subjected to grinding. This produces a tantalum powder 11 and a tungsten powder 21. Subsequently, the two metal powders 11, 21 are mixed to form a blended powder 43. It is important to note that the weight fraction of the tungsten powder 21 is larger in the blended powder 43 than in the desired alloy. This increase of the weight fraction can amount to 0.5 wt-% to 5 wt-% as compared to the tungsten fraction in the final alloy 100. A powder metallurgical route 50 is then used to produce a blended body 45 from the blended powder 43. Accordingly, heat treatment of the blended powder 43 produces a solid blended body 45.

In the method according to one embodiment, a pre-alloy 90 is produced from the blended body 45 initially. This is done in the scope of a first melting 61 by means of a melt metallurgical route 60. At least a fraction of at least one further metal 10, 30 is added in the scope of said first melting 61. As detailed above, another fraction of tantalum 10 and/or tungsten 20 and/or niobium 30 can be added to the blended body 45 and melted. Accordingly, the pre-alloy 90 does not include the same weight fractions of the three metals 10, 20, 30 which the later alloy 100 is to have. In order to attain the latter, a second melting 62 is carried out, also by means of the melt metallurgical route 60. In the process, the remaining fractions of the metals 10, 20, 30 are added to the pre-alloy 90 in order to thus attain the desired alloy 100.

In the scope of one embodiment, the term, powder metallurgical route, shall in particular refer to the manufacturing of a product in the following steps, whereby each of the steps can take a different form:

1) producing a metal powder 11, 21;
2) shaping; and
3) heat treatment.

For manufacturing an alloy 100 by means of the powder metallurgical route 50, metal powders of the metals having powder particle sizes between 10 μm and 0.1 μm are needed. The type of powder production has a major impact on the properties of the powders. Mechanical methods, chemical reduction methods or electrolytic methods as well as the carbonyl methods, spinning, atomizing, and other methods, can be used to produce the powder. The shaping involves compaction of the metal powder in compacting tools under high pressure (between 1 and 10 t/cm$^2$ (tons per square centimeter) to form green compacts. Other feasible methods include compaction by vibration, slip casting method, casting methods and methods involving the addition of binding agents. In heat treatment (also called sintering), the powder particles are solidly bonded at their contact surfaces by diffusion of the metal atoms. The sintering temperature of single-phase powders is between 65 and 80% of the solidus temperature.

Figure 2:
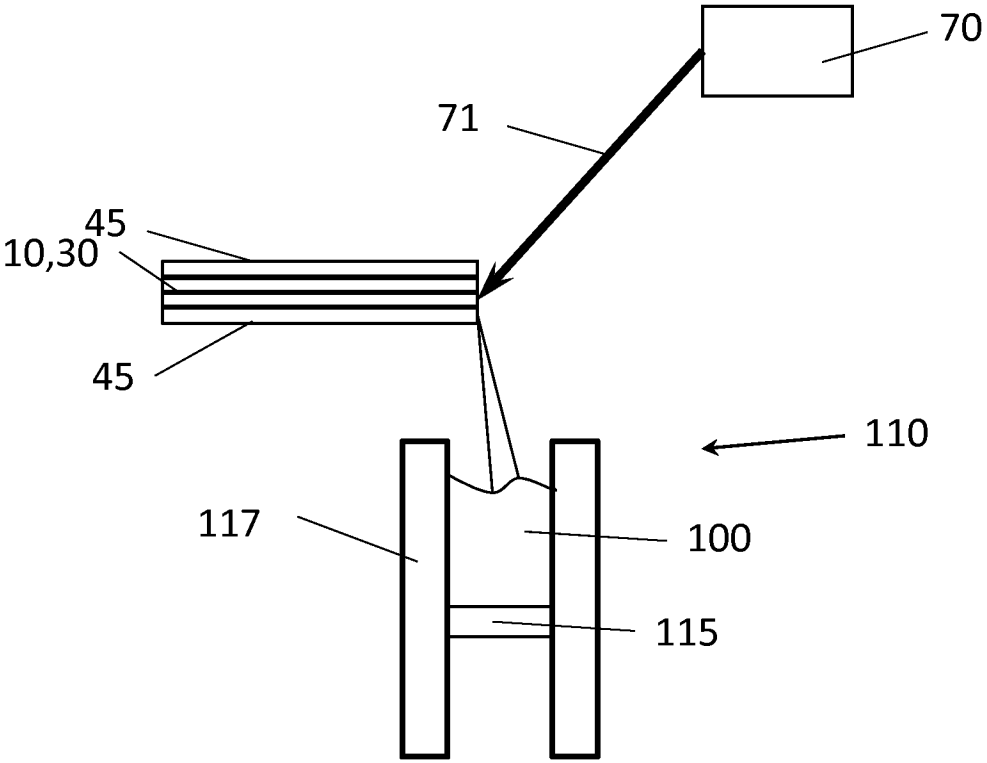
FIG. 2 illustrates a schematic view of a melt metallurgical processing within the scope of the method according to one embodiment.

The purpose of FIG. 2 is to illustrate the melt metallurgical route 60 by means of an electron beam melting process. As has been discussed above, a blended body 45 can be produced from the tantalum powder 11 and tungsten powder 21 by means of the powder metallurgical route 50. Subsequently, said blended body 45 is arranged spatially in a vacuum chamber next to at least a fraction of at least one further metal 10, 30. An electron source 70 generates an electron beam 71 that knocks single metal particles from the blended body 45. The melted metal particles flow into the ingot mould 110 where they form the alloy 100. For the alloy 100 to solidify quickly, the walls 117 of the ingot mould are cooled. A floor 115 that can be lowered ensures that the path the melted metal particles need to travel until they impact the surface of the alloy 100 is always the same.

One development of the method according to one embodiment provides the alloy 100 to be melted again after step e) by means of the melt metallurgical route 60. Multiple melting of the alloy 100 by means of the melt metallurgical route 60 allows the size of the inclusions of the first metal 10 and/or the second metal 20 and/or the third metal 30 in the alloy 100 to be reduced further. It has proven to be advantageous in one embodiment to melt the alloy 100 three to five times by melt metallurgical means after producing it. In the process, it is feasible to attain inclusions of the first metal 10 and/or the second metal 20 and/or the third metal 30 that are between 4 μm and 20 nm in size. Inclusions of this type have negligible impacts on the fatigue resistance of the alloy in implantable medical devices.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method for producing an alloy, whereby the alloy consists of three metals and the three metals are selected from the group consisting of tantalum, tungsten, and niobium, characterized in that the method includes the steps of:

a) grinding the tantalum to form a tantalum powder and grinding the tungsten to form a tungsten powder;

b) mixing the tantalum powder and the tungsten powder to form a blended powder, whereby a weight fraction of tungsten powder in the blended powder is larger than in the alloy;

c) producing a blended body from the blended powder by means of a powder metallurgical route;

d) producing a pre-alloy by means of a first melting of the blended body and at least a fraction of at least one further metal by means of a melt metallurgical route; and e) producing the alloy by means of a second melting of the pre-alloy and a remaining fraction of at least one metal by means of a melt metallurgical route.

2. The method according to claim 1, characterized in that steps d) and e) are carried out as follows by:

d) producing the pre-alloy by means of the first melting of the blended body and tantalum by means of a melt metallurgical route, and e) producing the alloy by means of the second melting of the pre-alloy and niobium by means of a melt metallurgical route.

3. The method according to claim 1, characterized in that a weight fraction of niobium and/or tantalum in the first melting is 0.5 wt-% to 4 wt-% larger than in the alloy.

4. The method according to claim 1, characterized in that a weight fraction of niobium and/or tantalum in the first melting is 1 wt-% to 2 wt-%, larger than in the alloy.

5. The method according to claim 1, characterized in that the particle size of the tantalum powder and/or tungsten powder is less than 10 μm.

6. The method according to claim 1, characterized in that the particle size of the tantalum powder and/or tungsten powder is less than 4 μm.

7. The method according to claim 1, characterized in that the alloy includes the following weight fractions of the metals:

0.5 wt-% to 15 wt-% tungsten, 2 wt-% to 20 wt-% niobium, and tantalum accounting for the remaining fraction.

8. The method according to claim 1, characterized in that the alloy includes the following weight fractions of the metals:

5.5 wt-% to 9.5 wt-% tungsten 8 wt-% to 12 wt-% niobium, and tantalum accounting for the remaining fraction.

9. The method according to claim 1, characterized in that the alloy includes the following weight fractions of the metals:

7.5 wt-% tungsten, 10 wt-% niobium and tantalum accounting for the remaining fraction.

10. The method according to claim 1, characterized in that the method includes, after step e), the step of:

f) melting the alloy by means of the melt metallurgical route.

11. A method for producing an alloy comprising:

grinding tantalum to form a tantalum powder and grinding tungsten to form a tungsten powder;

mixing the tantalum powder and the tungsten powder to form a blended powder, whereby a weight fraction of tungsten powder in the blended powder is larger than in the produced alloy;

producing a blended body from the blended powder by means of a powder metallurgical route;

producing a pre-alloy by means of a first melting of the blended body and at least a fraction of at least one further metal by means of a melt metallurgical route; and producing the alloy by means of a second melting of the pre-alloy and a remaining fraction of at least one metal by means of a melt metallurgical route;

wherein the alloy consists of three metals and the three metals are selected from the group consisting of tantalum, tungsten, and niobium.

* * * * *